United States Patent [19]

Schoeps

[11] 4,002,212

[45] Jan. 11, 1977

[54] ROTARY IMPACT MECHANISM

[75] Inventor: Knut Christian Schoeps, Tyreso, Sweden

[73] Assignee: Atlas Copco Aktiebolag, Nacka, Sweden

[22] Filed: Sept. 22, 1975

[21] Appl. No.: 615,429

[30] Foreign Application Priority Data

Oct. 2, 1974 Sweden ..... 7412380

[52] U.S. Cl. ..... 173/93.5

[51] Int. Cl.[2] ..... B25D 15/00

[58] Field of Search ..... 173/48, 47, 93, 93.5, 173/93.6, 93.7

[56] References Cited

UNITED STATES PATENTS

| | | | |
|---|---|---|---|
| 3,606,931 | 9/1971 | Karden | 173/93.5 |
| 3,648,784 | 3/1972 | Schoeps | 173/93.5 |
| 3,661,217 | 5/1972 | Maurer | 173/93.5 |
| 3,789,934 | 2/1974 | Schoeps et al. | 173/93.5 |

*Primary Examiner*—James A. Leppink
*Attorney, Agent, or Firm*—Flynn & Frishauf

[57] ABSTRACT

A rotary impact mechanism comprising a rotatable anvil, a rotatably driven hammer, an impact dog rotatably supported by the hammer and a rotatable control spindle which is lockable against rotation relative to the anvil. When locked against rotation the control spindle is arranged to engage the impact dog for shifting the latter from a free-running position to an impact position in which it instantaneously interconnects the hammer and the anvil, thereby providing for a kinetic energy transfer from the hammer to the anvil. A lock dog which is arranged to lock the control spindle against rotation relative to the anvil is arranged to be engaged by a release cam for unlocking the control spindle every second revolution of the hammer.

7 Claims, 4 Drawing Figures

ROTARY IMPACT MECHANISM

This invention relates to a rotary impact mechanism for, for instance impact wrenches. Particularly the invention relates to a rotary impact mechanism by which it is possible to obtain a high impact energy per impact in relationship to its weight and overall dimensions. This is accomplished by letting the rotating hammer accelerate over more than one revolution before each impact. However, impact mechanisms operating according to this principle are previously known. Yet, such known devices suffer from draw-backs like complicity as regard construction and a high manufacturing cost.

By this invention, as it is defined in the claims, there is made a rotary impact mechanism of the abovementioned type which is simple as regard construction and cheap in manufacturing.

An impact mechanism of a conventional type is described in the Swedish Pat. No. 333.906. In the impact mechanism disclosed therein the hammer is accelerated over one revolution only before each impact.

BRIEF DESCRIPTION OF THE DRAWINGS

A preferred embodiment of the invention is hereinbelow described with reference to the accompanying drawings on which

DETAILED DESCRIPTION

Figure 1:
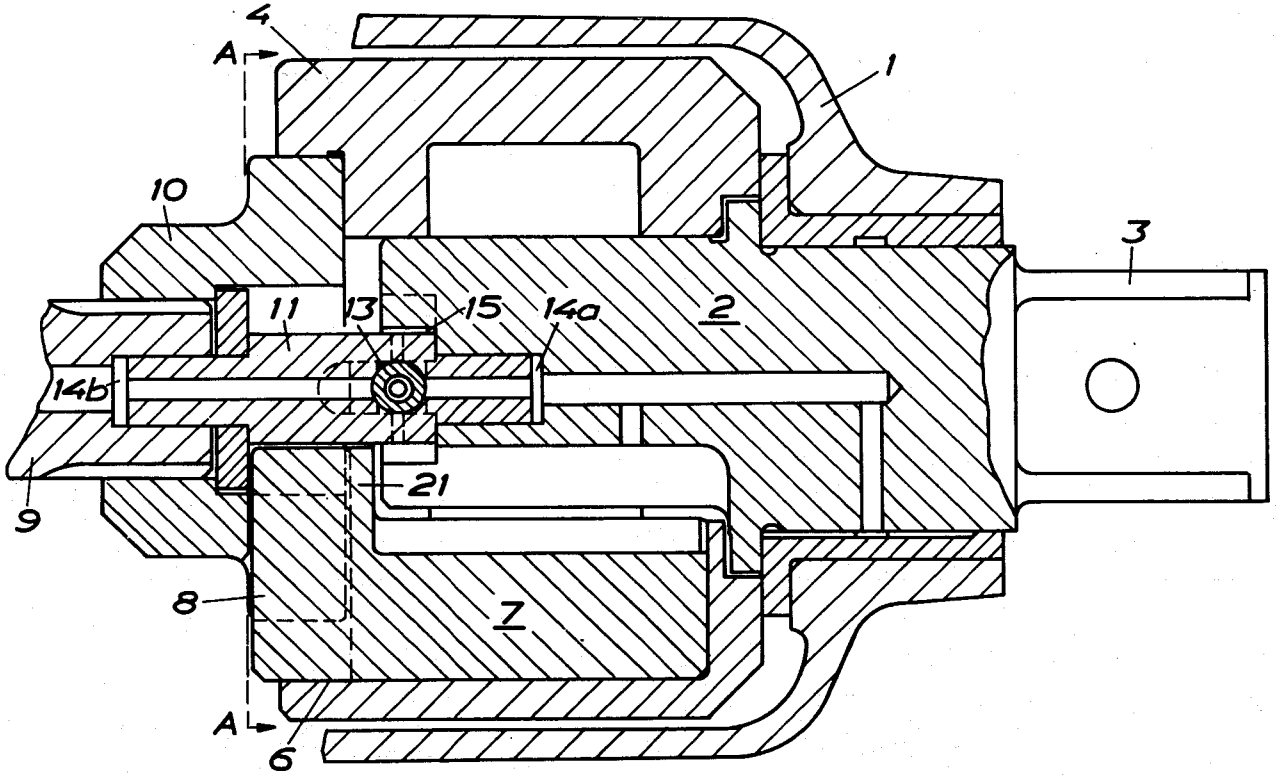
FIG. 1 shows a longitudinal section through a rotary impact mechanism according to the invention.
Figure 2:
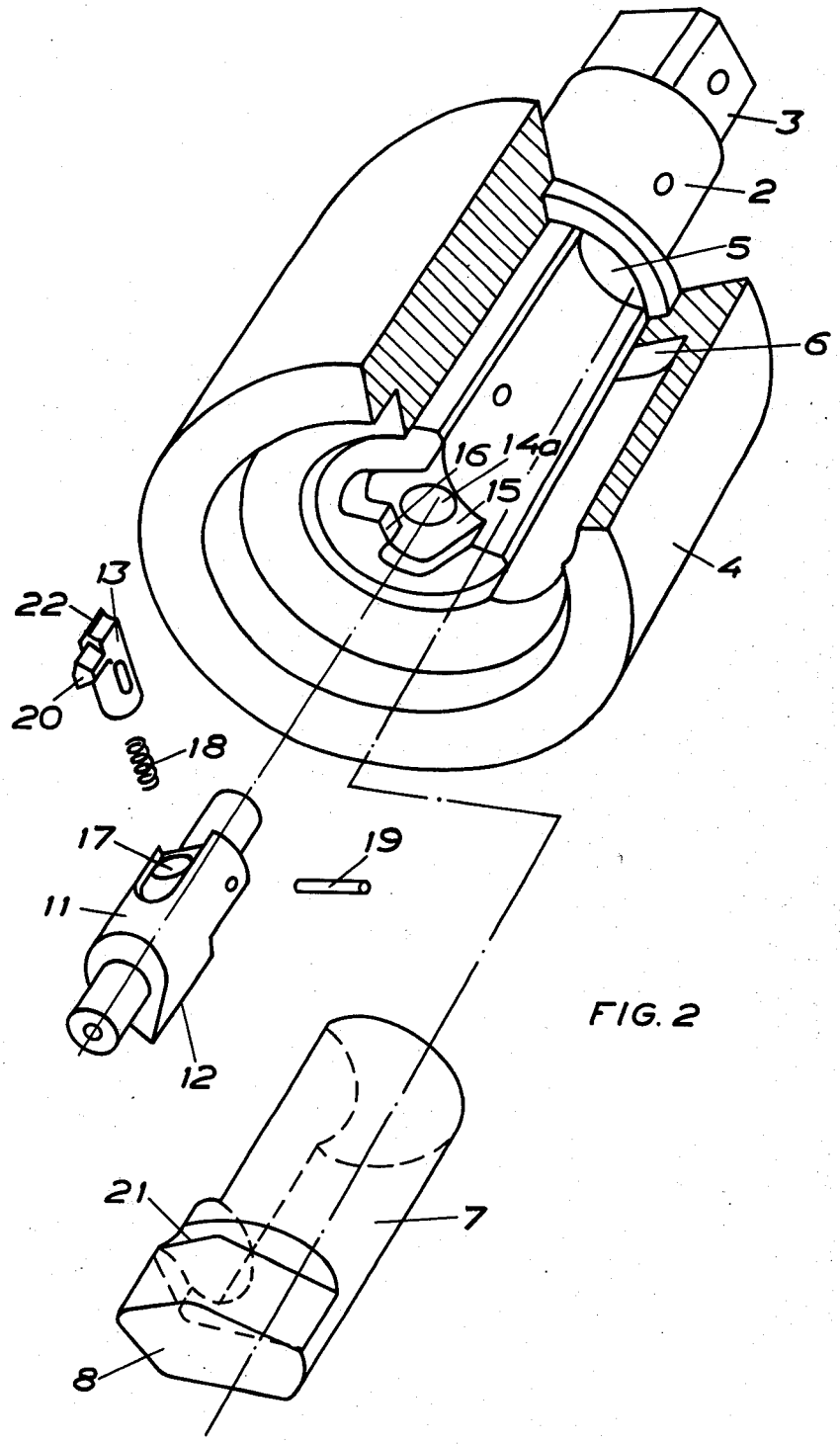
FIG. 2 shows perspectively an exploded view of the impact mechanism in FIG. 1.
Figure 3:
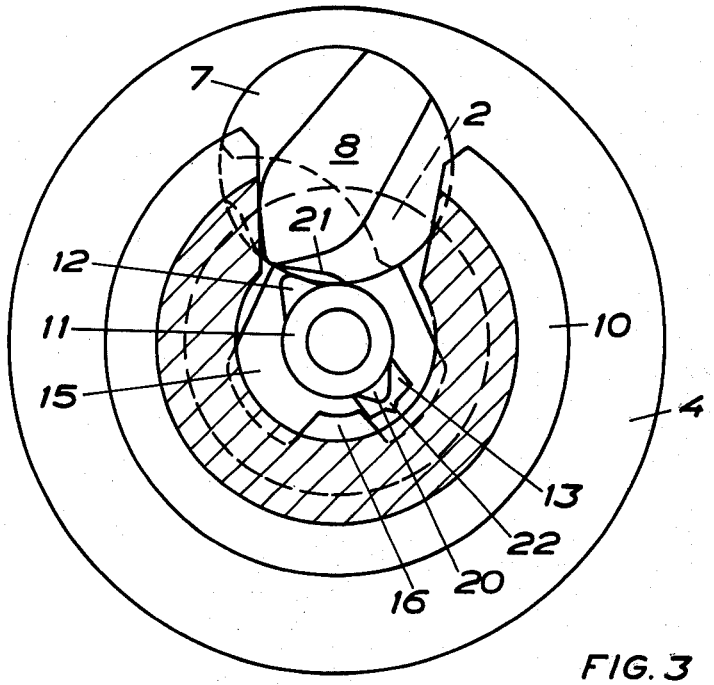
FIGS. 3 and 4 show end views of the impact mechanism taken along line A—A in FIG. 1 and show the impact mechanism in its impact and free-running positions respectively.

In the figures, 1 designates a housing surrounding the impact mechanism. In the housing 1 there is rotatably journalled an anvil 2 which is provided with a square portion 3 at its front end which portion extends out of the housing 1 for connection of a nut socket. At its rear end, the anvil 2 rotatably supports an annular hammer 4. The anvil 2 also includes a longitudinal part-cylindrical recess 5 the flanks of which constitute impact surfaces. The hammer 4 is formed with a part-cylindrical recess 6 in which an impact dog 7 is rotatably supported. The object of the impact dog 7 is to couple together the hammer 4 and the anvil 2 in order to transfer the kinetic energy of the rotating hammer 4 to either of the impact surfaces of the anvil 2.

The impact dog 7 has a meniscal cross section and is arranged to be completely received in the part-cylindrical recess 6 of the hammer 4 during the acceleration sequence of the latter. At its rear end the impact dog 7 is formed with a shifting cam 8 by which it is turnable between a free-running position e.g. when received in the recess 6 of the hammer 4 and an impact position.

The hammer 4 is rotated by a motor (not shown) through a shaft 9, a driving hub 10 and the impact dog 7. The driving hub 10 cooperates with a shifting cam 8 of the impact dog 7 in such a way that the impact dog is urged toward its free-running position by the motor power.

For initiating impacts the impact mechanism includes a control spindle 11 provided with an activating cam 12. Each impact is initiated in that the activating cam 12 engages the shifting cam 8 of the impact dog 7, whereby the latter is turned into its impact position. The control spindle 11 is rotatably journalled in concentric borings 14*a*, *b* in the anvil 2 and the driving shaft 9, respectively. The control spindle 11 is provided with a lock dog 13 which is arranged to operate in a recess 15 in the rear end of the anvil 2. The wall of the recess 15 is formed with an abutment heel 16 against which the lock dog 13 abuts, whereby the control spindle 11 is locked against rotation and the impact dog 7 is turned into its impact position by cooperation of activating cam 12 and shifting cam 8.

For enabling the hammer 4 to rotate over more than one revolution between each impact the lock dog 13 is arranged so as to be instantaneously moved out of its locking position. For that purpose the lock dog 13 is movably guided in a transverse guide way 17 in the control spindle 11. In order to obtain a radially and outwardly directed biasing force upon the lock dog 13, there is provided a spring 18. The spring 18 is arranged to take support against on one hand the lock dog 13 and on the other hand a pin 19 which is inserted in the control spindle 11 perpendicularly relative to the guide way 17. The protrusion of the lock dog 13 relative to the control spindle 11 is limited in that the pin 19 extends through an oval opening in the same.

For being turned to its inactive position the lock dog 13 is provided with a manouever cam 20 which is arranged to be acted upon by the release cam 21 of the impact dog 7. Further, the lock dog 13 is provided with a small holding rib 22 the purpose of which is to divide the release movement of the lock dog 13 into two steps. (The operation thereof is described herebelow.

The above described rotary impact mechanism operates as follows:

The driving hub 10 rotates the hammer 4 by engaging the shifting cam 8 of the impact dog 7. As the control spindle 11 is locked against rotation by the lock dog 13 the impact dog 7 will turn as the shifting cam 8 gets into contact with the activating cam 12. Thereby, the impact dog 7 is able to transfer kinetic energy of the hammer 4 to one of the impact surfaces of the anvil 2. (This is earlier described in detail in the Swedish Pat. No. 333.906 and, therefore, it is not described in detail). After the impact the driving hub 10 will turn the impact dog 7 back to the free-running position of the latter as a result of the driving force. Now, the hammer 4 is free to be accelerated again.

Figure 4:
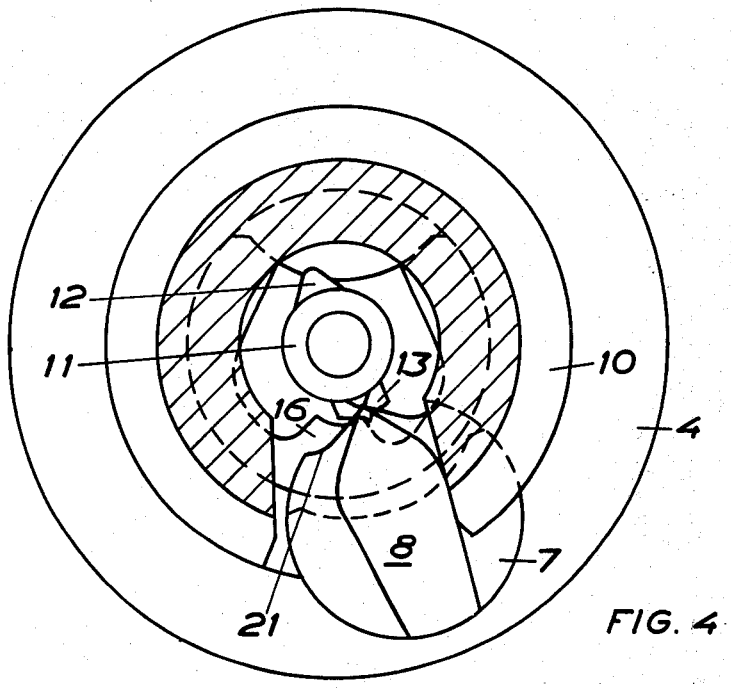

At continued rotation of the hammer 4, the impact dog 7 passes by the lock dog 13, whereby the manouever cam 20 of the latter is acted upon by the release cam 21. Thereupon, the lock dog 13 is pushed back into the guide way 17 of the control spindle 11 such a distance that except for the holding rib 22 it is out of the way for the abutment heel 16 of the anvil 2. (See FIG. 4).

At continued rotation of the hammer 4 the control spindle 11 is turned so that the lock dog 13 will be supported radially against the top of the abutment heel 16 of the anvil 2. The holding rib 22 prevents further rotation of the control spindle 11 under influence of the release cam 21.

After having rotated for still half a revolution the shifting cam 8 of the impact dog 7 will once again get into contact with the activating cam 12. As the latter in this position is locked against rotation by the small holding rib 22 only (see FIG. 4) no turning of the impact dog 7 occurs and because of that no impact will be initiated. Instead, the control spindle 11 is forced to rotate along with a hammer 4, as the rib 22 is forced to pass the heel 16 of the anvil 2.

At still further rotation the shifting cam 8 of the impact dog 7 rotates the control spindle 11 for almost a complete revolution. As the lock dog 13 by action of the spring 18 has reoccupied its fully extended position, it will once again engage the heel 16 of the anvil 2, whereupon another impact is initiated. At the impact moment the shifting cam 8 of the impact dog 7 passes by the activating cam 12 as previously described, whereupon the above related operation is repeated.

Because of the fact that impact surfaces, cam surfaces, manouever cams, the lock dog 13 and the heel 16 are symmetrically formed the impact mechanism may be operated in either direction.

The lock arrangement according to the above described embodiment of the invention is advantageous in that an impact mechanism of a conventional type, like the one described in the Swedish Pat. No. 333.906, easily may be converted into an impact mechanism having an essentially increased impact energy just by exchanging one single component, namely the control spindle 11. The control spindle of a conventional impact mechanism is formed with an unmovable lock dog and without a manouever cam. Thus, for heavy duty operation it is possible to obtain an increased impact energy by exchanging the control spindle. Thereby the impact energy is increased with about 50%.

The invention is not limited to the shown and described embodiment but can be freely varied within the limits of the claims.

What I claim is:

1. A rotary impact mechanism comprising a rotatable anvil (2), a hammer (4) coaxially rotatable relative to the anvil, an impact dog (7) which is shiftable between an impact position and a free-running position and which in its impact position interconnects the hammer (4) and the anvil (2), and a control spindle (11) arranged to initiate impacts by shifting the impact dog (7) from said free-running position to said impact position, the improvement comprising a lock dog (13) movable between an inactive position and a locking position in which latter position the control spindle (11) is caused to initiate an impact, a spring (18) biasing said lock dog (13) toward said locking position and a release cam (21) arranged for instantaneous displacement of said lock dog (13) to said inactive position during rotation of the hammer (4).

2. A rotary impact mechanism according to claim 1, wherein the control spindle (11) is rotatably journalled and supports movably said lock dog (13), said anvil (2) has a heel (16), and said lock dog (13) is arranged to abutt in its locking position against said heel (16) on the anvil (2) for locking the control spindle (11) against rotation relative thereto.

3. A rotary impact mechanism according to claim 2, wherein said control spindle (11) has a transverse guideway (17) therein, and said lock dog (13) is movably guided in said transverse guide way (17) in the control spindle (11) and is provided with a maneuver cam (20) for cooperation with said release cam (21).

4. A rotary impact mechanism according to claim 2, wherein the impact dog (7) is rotatably supported by the hammer (4) for rotation about an axis which is parallel to but offset from the rotation axis of the hammer (4), and said release cam (21) is arranged on the impact dog (7).

5. A rotary impact mechanism according to claim 4, wherein said control spindle (11) has a transverse guideway (17) therein, and said lock dog (13) is movably guided in said transverse guide way (17) in the control spindle (11) and is provided with a maneuver cam (20) for cooperation with said release cam (21).

6. A rotary impact mechanism according to claim 1, wherein the impact dog (7) is rotatably supported by the hammer (4) for rotation about an axis which is parallel to but offset from the rotation axis of the hammer (4), and said release cam (21) is arranged on the impact dog (7).

7. A rotary impact mechanism according to claim 6, wherein said control spindle (11) has a transverse guideway (17) therein, and said lock dog (13) is movably guided in said transverse guide way (17) in the control spindle (11) and is provided with a maneuver cam (20) for cooperation with said release cam (21).

* * * * *